United States Patent [19]

Idec

[11] 3,951,157

[45] Apr. 20, 1976

[54] COMBINED CONTAINER AND APPLICATOR FOR COSMETIC OR THE LIKE MATERIAL

[75] Inventor: Eric J. Idec, Cheshire, Conn.

[73] Assignee: Eyelet Specialty Co., Inc., Wallingford, Conn.

[22] Filed: Apr. 2, 1975

[21] Appl. No.: 564,331

[52] U.S. Cl. ..... 132/88.7; 401/130

[51] Int. Cl.[2] ..... A45D 40/26

[58] Field of Search ..... 132/88.7, 88.5, 120; 15/140.3; 401/122, 130, 261, 265–266

[56] References Cited

UNITED STATES PATENTS

| | | | |
|---|---|---|---|
| 1,839,548 | 1/1932 | Gimonet | 401/169 |
| 1,909,096 | 5/1933 | Cooney | 401/130 |
| 2,442,503 | 6/1948 | Melinikoff | 132/88.7 |
| 2,570,596 | 10/1951 | Ross | 15/140.3 |
| 3,084,374 | 4/1963 | Zieglor | 401/122 |
| 3,892,248 | 7/1975 | Kingsford | 132/88.7 |

*Primary Examiner*—G. E. McNeill

*Attorney, Agent, or Firm*—Hopgood, Calimafde, Kalil, Blaustein & Lieberman

[57] ABSTRACT

The invention contemplates an improved container and applicator for metered loading of the applicator upon each removal thereof from the container. In specific application to dispensing of powdered cosmetic, a central metering tube extends from the container-neck opening and into the interior of the container. The lower end of the tube has plural openings for limited passage of container contents, and the dauber end of a removable applicator wipes the tube at the region of its openings, in the course of applicator removal and replacement.

12 Claims, 5 Drawing Figures

COMBINED CONTAINER AND APPLICATOR FOR COSMETIC OR THE LIKE MATERIAL

The invention relates to a cosmetic or the like container having particular utility in the controlled applicator-dispensing of a powdered product.

It is an object of the invention to provide an improved construction of the character indicated.

Another object is to provide for a metered or restricted dispensing of product, upon each applicator removal from a device of the character indicated.

A specific object is to meet the above objects with a simple and inexpensive construction.

A further specific object is to meet the above objects with a construction which will inherently resist excessive applicator pickup of product, regardless of container orientation and vibration between uses.

Other objects and various further features of novelty and invention will be pointed out or will occur to those skilled in the art from a reading of the following specification in conjunction with the accompanying drawings. In said drawings, which show, for illustrative purposes only, preferred forms of the invention:

Figure 1:
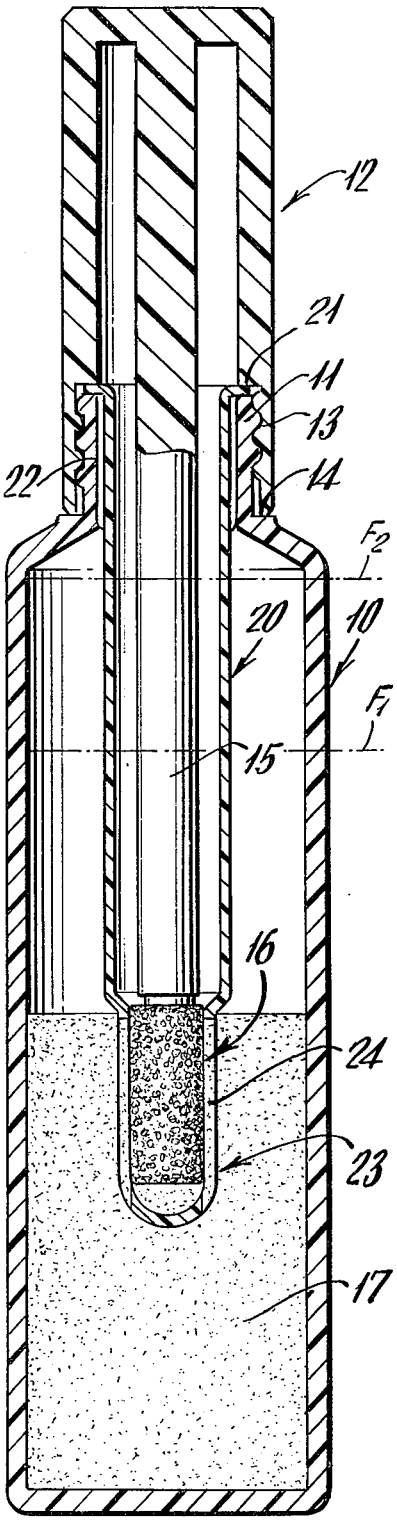
FIG. 1 is a view in longitudinal section showing a container and applicator of the invention.

Referring to FIG. 1 of the drawings, the invention is shown in application to an elongate container or vial having a body 10 which may be blow-molded of suitable plastic. Body 10 is characterized by a closed lower end and by a reduced tubular neck 11 at its upper end. A closure cap 12 and neck 11 have thread formations 13 for securing selective closure of the container, upon driving the skirt of cap 12 against a shoulder 14 at the base of neck 11. Integrally formed with cap 12 is an elongate applicator wand 15 having a lower or dauber end 16 which extends well down into the interior space of the container body, when the cap 12 is secured. The product 17 in body 10 may be a cosmetic substance such as a powder.

Figure 2:
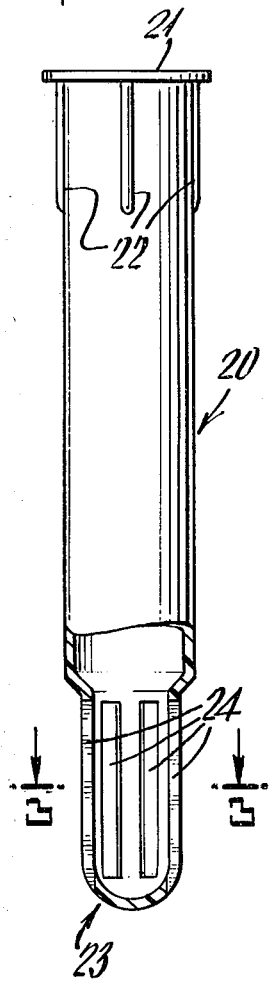
FIG. 2 is a view in elevation of a product-metering element of the container of FIG. 1.
Figure 3:
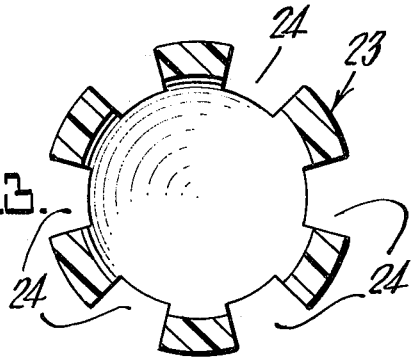
FIG. 3 is an enlarged sectional view, taken at 3—3 in FIG. 2.

In accordance with the invention, dauber exposure to product 17 is metered by means of a tubular insert 20, which may be injection-molded of suitable plastic such as polypropylene. Insert 20 has an outwardly flanged upper end 21 to seat against neck 11, and elongate ribs 22 adjacent flange 21 enable permanent force-fit assembly to the cylindrical bore of neck 11. The inwardly projecting or lower end portion 23 of insert 20 is of reduced cylindrical configuration, and plural openings such as elongate slots 24 provide metering for passage of product into contact with dauber 16. As best seen in FIGS. 2 and 3, the slots 24 are axially through to the rounded end of the reduced cylindrical portion 23, being molded by retractable angularly spaced finger elements which can be axially removed to dislodge a molded part.

Preferably, the dauber formations at 16 are provided by a tubular sponge element 16' (FIG. 4) fixed to a reduced stem portion 15' of the wand 15. Sponge 16' provides a yieldable generally cylindrical external contour for dauber 16, and the unstressed diameter of this contour is preferably such as to establish light interference fit to the bore of the reduced cylindrical portion 23, upon applicator replacement. Still further, the axial overlap of dauber 16 with portion 23 is preferably such as to assure effective closure of all slotted openings 24, upon securing cap 12 in place.

Figure 4:
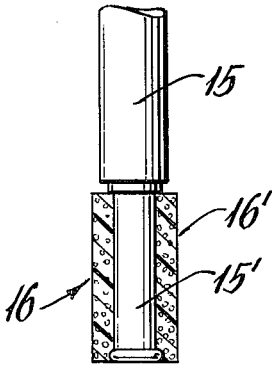
FIG. 4 is a fragmentary view in partial longitudinal section, for the dauber end of a part of the applicator of FIG. 1.
Figure 5:
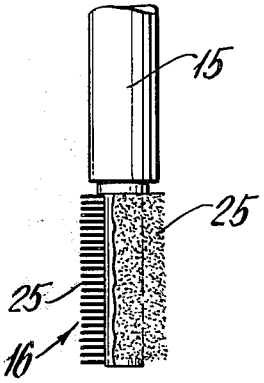
FIG. 5 is a view similar to FIG. 4 to show a modification.

In the arrangement of FIG. 5, the dauber end 16 of applicator 15 comprises clustered brush bristles 25 establishing an outer contour of the yieldable interference-fitting nature described for the sponge dauber 16' of FIG. 4.

In use, the placement of cap 12 will be understood to establish first and second stabilizing seals (a) at shoulder 14 and (b) at compression of flange 21 between neck 11 and a counterbore shoulder 26 in cap 12; at the same time, dauber 16 is fully nested in the reduced metering end 23 of the tubular insert, closing all slotted openings thereof against product passage. To use the device, cap-unthreading entails a rotational wipe of dauber surface against the metering slots 24, thus limiting the quantity of entrained cosmetic product. Cap manipulation serves also for dauber application, as needed. Cap replacement involves guided piloting of the dauber in the bore of insert 22, and final threading to the sealed and closed condition already described.

To load the container, powder or the like contents are inserted prior to assembly of insert 20. Insert 20, with a removable ram (which fills portion 23 and closes slots 24), are then inserted and the force-fit accomplished at 22. Thereafter, the cap and applicator are secured.

More specifically, in FIG. 1 the level $F_1$ indicates the level of initial fill in the absence of insert 20, while the level $F_2$ indicates the ultimate level of fill with the same volume of powder product, with insert 20 assembled. It will be understood that the requisite powder displacement to achieve level $F_2$ prior to assembly of insert 20 may, inter alia, be achieved by use of a temporary (i.e., removable) plug having substantially the contour of insert 20, fill being applied via the container neck to level $F_2$, and the temporary plug being then removed and replaced by insert 20, force-fitted as described.

It will be seen that the described construction meets all stated objects, with elemental simplicity, both as to construction and as to ease of use. When the inventive applicator is used for powder application, it eliminates the mess of dusting, while also avoiding excessive loading of the applicator. As a result, product is conserved, and the quality and precision of product application are enhanced.

While the invention has been described in detail for the preferred forms shown, it will be understood that modifications may be made without departing from the invention.

What is claimed is:

1. A cosmetic or the like container for the controlled dispensing of powdered or other product contents, comprising an elongate container body closed at one end and having a reduced neck opening at the other end, an elongate tubular member secured at said neck end and extending substantially into the inner volume of said container body, whereby the inwardly projecting position of said tubular member is necessarily directly immersed in and exposed to product contents of the container body, the inwardly projected end portion of said tubular member having plural openings for restricted passage of container-product contents into said tubular member, and an elongate applicator removably enterable into the neck-mounted end of said tubular member and having product-daubing formations at its lower end in axial registry with at least some of said openings when inserted into said tubular member.

2. The container of claim 1, in which the upper end of said applicator has a closure-cap formation removably securable over the neck of said container body.

3. The container of claim 2, in which the neck and closure-cap formations include coacting threads, whereby the dauber formations are caused to rotationally sweep through registry with a plurality of tubular member openings in the course of applicator removal.

4. The container of claim 1, in which the applicator openings are a plurality of angularly spaced elongate narrow slots at the inner end of said applicator.

5. The container of claim 4, in which said dauber formations are in substantial axial overlap with said slots for the fully inserted condition of said applicator.

6. The container of claim 1, in which said tubular member has a reduced cylindrical portion at the inwardly projected end thereof, and in which the tubular-member openings are in said reduced portion.

7. The container of claim 6, in which said dauber formations are characterized by a yieldable generally cylindrical exterior in interference fit relation with the bore of said reduced cylindrical portion when inserted therein.

8. The container of claim 7, in which substantially all the tubular-member openings are effectively closed by said dauber formations when the latter is in fully inserted position.

9. The container of claim 1, in which said dauber formations are defined by a sleeve of sponge material carried at the lower end of said applicator.

10. The container of claim 1, in which said tubular member has a radially outward flange at its upper end, said flange being fitted to said neck, and a closure cap removably fitted to said neck and in seated relation to said flange when in container-closing position.

11. The container of claim 1, in which said tubular member is secured by press-fit to the neck opening.

12. The container of claim 1, in which said dauber formations are brush bristles.

* * * * *